United States Patent [19]

Chellis

[11] 4,180,984

[45] Jan. 1, 1980

[54] CRYOGENIC APPARATUS HAVING MEANS TO COORDINATE DISPLACER MOTION WITH FLUID CONTROL MEANS REGARDLESS OF THE DIRECTION OF ROTATION OF THE DRIVE SHAFT

[75] Inventor: Fred F. Chellis, Concord, Mass.

[73] Assignee: Helix Technology Corporation, Waltham, Mass.

[21] Appl. No.: 866,148

[22] Filed: Dec. 30, 1977

[51] Int. Cl.[2] ..... F25B 9/00; F01B 29/10; F02G 1/04

[52] U.S. Cl. ..... 62/6; 60/522

[58] Field of Search ..... 62/6; 60/518, 522

[56] References Cited

U.S. PATENT DOCUMENTS

| | | | |
|---|---|---|---|
| 3,205,668 | 9/1965 | Gifford | 62/6 |
| 3,312,239 | 4/1967 | Chellis | 62/6 |
| 3,625,015 | 12/1971 | Chellis | 62/6 |

*Primary Examiner*—Lloyd L. King

*Attorney, Agent, or Firm*—David E. Brook

[57] ABSTRACT

In a cryogenic apparatus wherein the refrigerator has a reciprocable displacer which must be coordinated with fluid control means, such as a rotary valve, to control the inlet and exhausting of high and low pressure fluid, respectively, to produce cooling, an improvement is disclosed comprising including means for providing proper coordination between displacer movement and fluid control means regardless of the direction in which the motor drive shaft is rotated.

13 Claims, 5 Drawing Figures

CRYOGENIC APPARATUS HAVING MEANS TO COORDINATE DISPLACER MOTION WITH FLUID CONTROL MEANS REGARDLESS OF THE DIRECTION OF ROTATION OF THE DRIVE SHAFT

BACKGROUND OF THE INVENTION

1. Field of the Invention

This invention is in the field of cryogenic apparatus.

2. Description of the Prior Art

A refrigeration cycle, often referred to as a Gifford-McMahon cycle, requires that a high-pressure fluid be introduced into a "warm" chamber of variable volume to flow along a heat storage path into at least one "cold" chamber of variable volume, that the volumes of these chambers be varied by the movement of a displacer and that the fluid be discharged as low-pressure fluid into a low-pressure fluid reservoir, e.g., the inlet of a compressor. The control of fluid flow and movement of the displacer must be continuously and accurately timed, and the action of the valves controlling the fluid flow must be perfectly coordinated with the mechanical driving means associated with the displacer. Cryogenic apparatus which operates on such a cycle is described in U.S. Pat. No. 2,996,035, issued to Gifford.

A rotary valve apparatus designed to provide the required coordination in cryogenic apparatus based on the Gifford-McMahon cycle is disclosed in U.S. Pat. No. 3,625,015, issued to Chellis. The valve comprises a stationary valve plate having a fluid passage therein which is in fluid communication with the warm chamber of the refrigerator. The valve also has a rotatable valve disc in surface contact with the valve plate to define therebetween a high-pressure fluid passage and a low-pressure fluid passage which are alternately brought into fluid communication with the fluid passage in the valve plate as the rotary valve disc is rotated. Both the displacer and rotary disc are driven by a common rotary drive shaft, which is in turn driven by an electric motor.

This rotary valve apparatus has proven to be extremely effective for providing the required coordination between fluid flow and displacer movement which is required for cooling as long as the motor shaft is rotated in the intended direction. It is always possible, however, for the motor shaft to be operated in the opposite direction from that intended. For example, some motors will rotate in the opposite direction if they are improperly wired. When this happens, cooling does not result, but instead, heating occurs which often produces serious damage to the cold end components in a cryogenic apparatus. Because of the problems which can result from rotation of the drive shaft in an unintended direction, it would be desirable to have a mechanism for providing proper coordination between displacer movement and fluid flow even if the drive shaft were turned in the wrong direction for any reason.

SUMMARY OF THE INVENTION

This invention relates to an improvement in a cryogenic apparatus requiring proper coordination between a displacer and fluid control means. More specifically, the invention described herein comprises the improvement of including means for providing proper coordination between displacer movement and fluid control means in cryogenic apparatus even if the drive shaft is operated in a direction opposite to that intended.

In one embodiment, suitable means for providing proper coordination are designed for use in a cryogenic apparatus operating on the Gifford-McMahon cycle and including a rotary valve of the type described by Chellis in U.S. Pat. No. 3,265,015. This apparatus is a rotary-valved, mechanically driven cryogenic apparatus comprising a number of components in combination. A fluid-tight enclosure defines a refrigerator which includes displacer means movable within the refrigerator to define a warm chamber of variable volume and at least one cold expansion chamber of variable volume. Fluid control means adapted to control the sequential delivery of high-pressure fluid into and the exhausting of low-pressure fluid from the refrigerator include a stationary valve plate and a rotary valve disc. The stationary valve plate has a fluid passage in communication with the warm chamber of the refrigerator. The valve disc is rotatable in surface contact with the valve plate to define therebetween a high-pressure fluid passage and a low-pressure fluid passage which are alternately in communication with the fluid passage in the valve plate as the valve disc is rotated. First and second fluid passages serve to deliver high-pressure fluid to and receive expanded fluid from the high-pressure fluid passage and low-pressure fluid passage, respectively, in the fluid control means. The rotary valve disc and reciprocable displacer are driven in coordinated fashion by mechanical driving means, such as a motor, so that high-pressure fluid is delivered to the refrigerator while the displacer is moved away from the refrigerator as the displacer travels towards the cold expansion chamber.

According to this invention, means for providing proper coordination between the reciprocable motion of the displacer and the rotation of the rotary valve disc when the mechanical driving means is driven in either direction are employed. Such means for providing might comprise, as a preferred embodiment, abutments positioned on the periphery of the rotary valve disc which cooperate with a lug on the rotary valve drive shaft. The lugs are positioned such that immediate engagement is made if the valve drive shaft is rotated in the intended direction but not if the drive shaft is rotated in the opposite direction. Thus, if the valve drive shaft is rotated in the direction opposite to that intended, it will complete part of its revolution before the lug engages an abutment on the rotary valve disc at which point proper coordination between the rotary valve disc and displacer will be reestablished.

The invention also has application in refrigeration apparatus based upon cycles other than the above-described Gifford-McMahon cycle. For example, it may be used with apparatus employing a Stirling cycle wherein coordination is required between the translational movement of a piston and the reciprocable motion of a displacer.

Thus, this invention provides a safeguard to prevent heating, rather than cooling, and concomittant damage resulting therefrom, which might result in a cryogenic refrigeration apparatus if the required coordination is not established due to rotation of the drive shaft in an improper direction. The means for providing proper coordination can be employed with simple modifications to existing constructions and yet is inexpensive and highly reliable.

DESCRIPTION OF PREFERRED EMBODIMENTS

Figure 1:
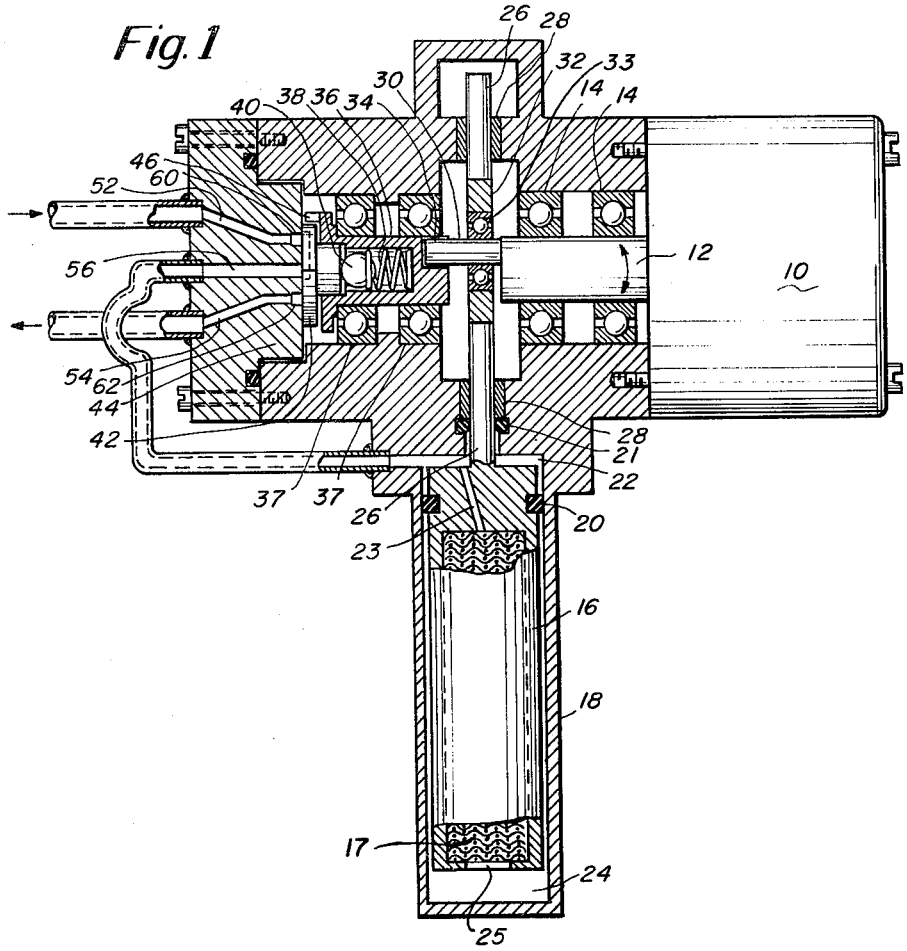
FIG. 1 is a partially cut-away cross-sectional view of cryogenic apparatus designed to operate on a Gifford-McMahon cycle.
Figure 3:
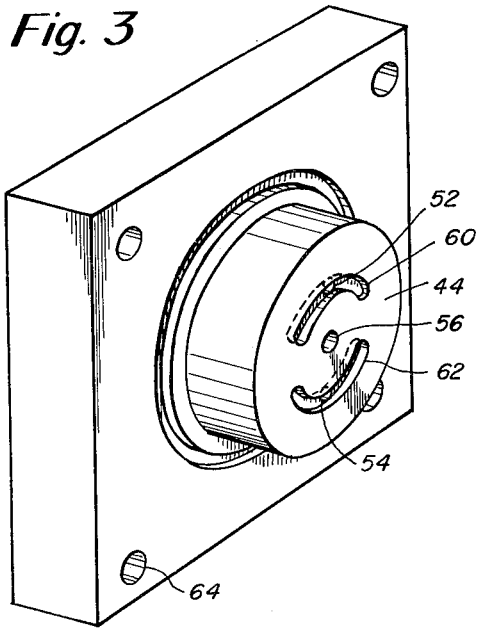
FIG. 3 is a perspective view of a rotary valve plate for use in an apparatus of FIG. 1.
Figure 2:
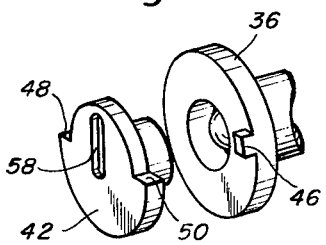
FIG. 2 is a perspective view illustrating the cooperation between abutments on the periphery of a rotary valve disc and a lug positioned on the rotary valve drive shaft for the apparatus of FIG. 1.

Cryogenic apparatus having the improvements described herein is illustrated in FIGS. 1-3. Such an apparatus is designed to operate on a so-called Gifford-McMahon cycle. It is understood, of course, that the housing employed would normally be fluid-tight.

In this apparatus, motor 10 serves as the mechanical driving means and has a main rotary drive shaft 12 supported by bearings 14. As indicated by the arrows, drive shaft 12 is capable of being rotated in either direction. Usually, however, only one of these directions will produce the coordination required to produce cooling.

A refrigerator assembly consists primarily of displacer 16 contained within enclosed housing 18 and provided with seals 20 and 21 to provide an upper, warm chamber 22 of variable volume, and a lower, cold expansion chamber 24 also of variable volume. As shown, displacer 16 contains a suitable heat storage means 17. Fluid can pass through heat storage means 17 via channels 23 or 25 which connect with warm chamber 22 and cold chamber 24, respectively. Displacer 16 is driven in a reciprocating manner by displacer shaft 26 which is held in place by bearings 28. Shaft 26 is coupled to main drive shaft 12 by crankpin 30 and scotch yoke 32. As main drive shaft 12 rotates, crankpin 30 and attached bearing 33 operate on scotch yoke 32 to drive shaft 26, and therefore, displacer 16, in a reciprocating manner. Crankpin 30 also has an extension 34 which engages with rotary valve drive shaft 36, which is supported by bearings 37.

As illustrated, rotary valve drive shaft 36 is hollow and contains therein a coil spring 38 and ball 40. Spring 38 biases rotary valve disc 42 against stationary valve plate 44 in sealing engagement therewith. Ball 40 is used to allow rotary valve disc 42 to swivel slightly and yet always engage in sealing contact with valve plate 44 even when slight misalignments occur.

As can be seen in FIG. 2, lug 46 is positioned upon rotary valve shaft 36 and cooperates with abutments 48 and 50 on the periphery of rotary valve disc 42. Rotary valve disc 42 is driven, then, by lug 46 which engages at either of abutments 48 or 50 to drive disc 42.

If main drive 12 is rotated in a clockwise manner, it can be seen that lug 46 will immediately engage abutment 50 to thereby rotate rotary valve disc 42. For purposes of illustration, it is assumed that clockwise rotation of main drive 12 and rotary valve disc 42 will produce the proper coordination between displacer 16 and rotary valve disc 42. If, for any reason, main drive 12 is rotated in a counterclockwise direction, rotary valve disc will not be rotated until lug 46 has traversed about 180°, at which point it will engage abutment 48. Because lug 46 is able to rotate without driving disc 42 when shaft 12 is driven in an improper direction, damage due to heating which would normally occur, is avoided. Valve disc 42 is not driven until proper coordination is reestablished, i.e., lug 46 has rotated 180°.

Rotary valve plate 44 remains stationary during operation of the apparatus. High-pressure fluid is transported through valve plate 44 via passage 52 to high pressure channel 60. A second passage 54 is provided through valve plate 44 for exhausting expanded low pressure fluid from channel 62. Passage 56 through the center of rotary valve plate 44 communicates directly with the warm chamber 22 above displacer 16.

The sequence of introduction of high-pressure fluid into the refrigerator assembly and the exhausting of low-pressure fluid therefrom is achieved as rotary valve disc 42 rotates. As can be seen, rotary valve disc 42 has an elongated channel 58 in its sealing surface which alternately contacts high-pressure channel 60 and low-pressure channel 62 contained within the face of rotary valve plate 44.

Although not limited thereto, the sealing face of rotary valve disc 42 is preferably polytetrafluoroethylene and stationary valve plate 44 is preferably fabricated from hard materials, such as hardcoated aluminum. Stationary valve plate 44 is typically joined to the fluid-tight housing of the overall apparatus by screws which extend through screw holes 64.

Figure 4:
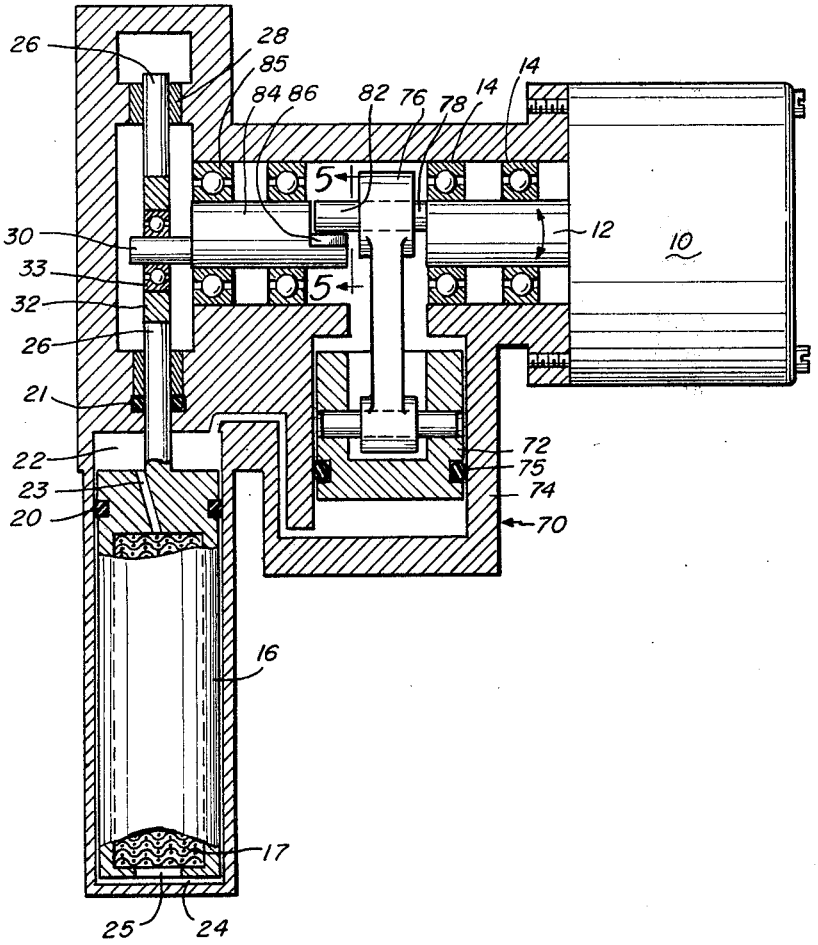
FIG. 4 is a partially cut-away cross-sectional view of a cryogenic apparatus employing a Stirling cycle; and, FIG. 5 is a partial sectional view illustrating the secondary drive shaft and crankpin extension which form the means for providing proper coordination employed in the cryogenic apparatus of FIG. 4.
Figure 5:
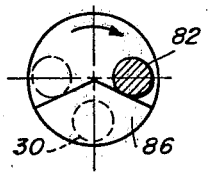

An alternative cryogenic apparatus is illustrated in FIGS. 4 and 5. In this apparatus, similar numerals have been used to refer to similar elements. Thus, motor 10 acts as a mechanical driving means for main drive shaft 12 contained in a rotatable relationship by bearings 14. This apparatus operates on a so-called "Stirling" cycle and thus, does not employ a rotary valve. Instead, a compressor assembly 70 consists primarily of piston 72 which is contained within housing 74 and sealed therein by seal 75. Piston 72 is driven in a reciprocable manner through connecting link 76 by crankpin 78, which is attached to the main drive shaft 12. Crankpin 78 has an extension 82, which engages a raised shoulder 86 on the end of secondary shaft 84 which is supported by bearings 85. The crankpin extension 82 may engage either side of raised shoulder 86 to drive displacer 16 in a reciprocating manner via crankpin 30, scotch yoke 32, bearings 33 and drive shaft 26.

As can be seen, particularly in FIG. 5, when motor 10 rotates main drive shaft 12 in a clockwise direction, crankpin extension 82 immediately abuts shoulder 86 to rotate secondary shaft 84 in the clockwise direction. The result is that displacer 16 is reciprocated about 90° in advance of movement of piston 72. However, if main drive shaft 12 were rotated in the counterclockwise direction for any reason, crankpin extension 82 would traverse approximately 270° without abuting shoulder 86 and without causing secondary drive shaft 84 to rotate. At this point, secondary shaft 84 would be rotated in the counterclockwise direction and displacer 16 would still be driven 90° in advance of piston 72. Thus, proper coordination between the piston 72 and displacer 16 is once again provided.

There are many equivalents to the specific elements illustrated herein which will be recognized by those skilled in the art. For example, the fluid control means need not be a rotary valve or compressor, as illustrated specifically. Other fluid control means, including, but not limited to, solenoids which are operated by cams positioned on the main drive shaft could also be used. All such equivalents are intended to be covered by the following claims.

What is claimed is:

1. In a cryogenic apparatus including a refrigerator having a reciprocable displacer; fluid control means for sequentially delivering a high pressure fluid to and exhausting a low pressure fluid from said refrigerator; and a motor driving a rotary drive shaft which operates the displacer and said fluid control means;

the improvement of additionally including means for providing proper coordination between the displacer and said fluid control means regardless of which direction said rotary drive shaft is rotated.

2. An improvement of claim 1 wherein said fluid control means comprises a piston.

3. An improvement of claim 2 wherein said means for providing proper coordination comprises a crankpin extension cooperating with a raised shoulder on one face of a secondary drive shaft which drives said displacer.

4. An improvement of claim 1 wherein said fluid control means comprises a rotary valve including a stationary valve plate and a rotary valve disc, said plate and said disc having one face of each in fluid sealing contact with each other.

5. An improvement of claim 4 wherein said means for providing proper coordination comprises means for mechanically linking said rotary valve to said drive shaft.

6. An improvement of claim 5 wherein said means for mechanically linking comprises abutments located on the periphery of said rotary valve disc and a lug positioned on said rotary drive shaft, said lug cooperating with said abutments to drive said rotary valve disc.

7. A rotary-valved, mechanically driven cryogenic apparatus, comprising in combination:

a. a fluid-tight enclosure defining a refrigerator;

b. displacer means movable within said refrigerator thereby to define a warm chamber of variable volume and at least one cold expansion chamber of variable volume;

c. fluid control means adapted to control the sequential delivery of high-pressure fluid to and the exhausting of low-pressure fluid from said refrigerator, said fluid control means comprising (1) a stationary valve plate having a fluid passage therein, said fluid passage being in fluid communication with the warm chamber of said refrigerator;

(2) a rotary valve disc in surface contact with said valve plate thereby to define with said valve plate a high-pressure fluid passage and a low-pressure fluid passage, said passages being alternately in fluid communication with said fluid passage in said valve plate as said rotary valve disc is rotated;

d. first fluid passage means adapted to deliver high-pressure fluid to said high-pressure fluid passage in said fluid control means;

e. second fluid passage means adapted to receive expanded fluid from said low-pressure fluid passage in said fluid control means;

f. mechanical driving means arranged to rotate said rotary valve disc and to impart reciprocal motion to said displacer, the rotation of said rotary valve disc and the reciprocal motion of said displacer being so coordinated that high-pressure fluid is delivered to said refrigerator while said displacer is moved away from said cold expansion chamber and low-pressure fluid is discharged from said refrigerator when said displacer is moved towards said cold expansion chamber; and, g. means for providing proper coordination between the reciprocable motion of said displacer and the rotation of said rotary valve disc when said mechanical driving means is driven in either direction.

8. A cryogenic apparatus of claim 7 wherein said mechanical driving means comprises:

a. a motor;

b. a main drive shaft driven by said motor;

c. a displacer shaft;

d. means to convert rotary motion to reciprocal motion mechanically link said main drive shaft and said displacer shaft; and, e. means to mechanically link said rotary valve to said main drive shaft.

9. A cryogenic apparatus of claim 8 wherein said means to convert rotary motion to reciprocal motion comprises an overhung crank linked to said main drive shaft and scotch yoke means driven by said crank and linked to said displacer shaft.

10. A cryogenic apparatus of claim 9 wherein the sealing face of said rotary valve disc comprises poly(tetrafluoroethylene).

11. A rotary-valved, mechanically driven cryogenic apparatus, comprising in combination:

a. a fluid-tight enclosure defining a refrigerator;

b. displacer means movable within said refrigerator thereby to define a warm chamber of variable volume and at least one cold expansion chamber of variable volume;

c. fluid control means adapted to control the sequential delivery of high-pressure fluid to and the exhausting of fluid from said refrigerator, said fluid control means comprising (1) a stationary valve plate having a fluid passage therein, said fluid passage being in fluid communication with the warm chamber of said refrigerator, (2) a rotary valve disc in surface contact with said valve plate thereby to define with said valve plate a high-pressure fluid passage and a low-pressure fluid passage, said passages being alternately in fluid communication with said fluid passage in said valve plate as said rotary valve is rotated;

d. first fluid passage means adapted to deliver high-pressure fluid to said high-pressure fluid passage in said fluid control means comprising a high-pressure fluid inlet conduit and a fluid passage extending through said rotary valve plate;

e. mechanical driving means arranged to rotate said rotary valve and to impart reciprocal motion to said displacer comprising (1) a motor, (2) a main drive shaft driven by said motor, (3) a displacer shaft, (4) means to convert rotary motion to reciprocal motion mechanically linking said main drive shaft and said displacer shaft, and (5) means to mechanically link said rotary valve to said main drive shaft, (6) fluid-tight enclosure means, the rotation of said rotary valve disc and the reciprocal motion of said displacer being so coordinated that high-pressure fluid is delivered to said refrigerator while said displacer is moved upwardly to a predetermined level and fluid is discharged from said refrigerator when said displacer reaches its uppermost position and while it travels downwardly to a predetermined level;

f. second fluid passage means adapted to receive expanded fluid from said low-pressure fluid passage in said fluid control means and conduct said expanded fluid to a low-pressure reservoir, said second fluid passage means including a fluid passage extending through said valve plate; and, g. means for providing the proper coordination between the reciprocable motion of said displacer and the rotation of said rotary valve regardless of which the direction of said main drive shaft is driven.

12. A cryogenic apparatus of claim 11 wherein said means for providing comprises abutments positioned on the periphery of said rotary valve disc and a lug positioned on a drive shaft, said abutments and said lug cooperating with each other to provide proper coordination of said displacer and said rotary valve disc.

13. A cryogenic apparatus of claim 12 wherein said means to convert rotary motion to reciprocal motion comprises an overhung crank linked to said main drive shaft and scotch yoke means driven by said crank and linked to said displacer shaft.

* * * * *